United States Patent [19]

Hennessy

[11] 4,189,869

[45] Feb. 26, 1980

[54] RAILWAY CAR DOOR MOVING MEANS

[75] Inventor: James J. Hennessy, Chambersburg, Pa.

[73] Assignee: Hennessy Products, Incorporated, Chambersburg, Pa.

[21] Appl. No.: 928,300

[22] Filed: Jul. 26, 1978

[51] Int. Cl.[2] ..... E05F 11/54

[52] U.S. Cl. ..... 49/358; 49/362; 16/117; 74/557

[58] Field of Search ..... 49/362, 363, 360, 358, 49/357; 109/64, 73; 16/117, 110; 74/557

[56] References Cited

U.S. PATENT DOCUMENTS

| | | | |
|---|---|---|---|
| 1,566,615 | 12/1925 | Pace et al. | 49/358 |
| 1,940,191 | 12/1933 | Simonton | 49/362 |
| 3,775,906 | 12/1973 | Dougherty | 49/358 |
| 3,857,300 | 12/1974 | O'Dell | 74/557 |

FOREIGN PATENT DOCUMENTS

| | | | |
|---|---|---|---|
| 1342610 | 1/1974 | United Kingdom | 49/360 |

*Primary Examiner*—Kenneth Downey
*Attorney, Agent, or Firm*—F. Travers Burgess

[57] ABSTRACT

Structure for closing and opening railway house car sliding doors comprises a rack member affixed to the door track, bracket structure mounted on the door and extending rearwardly therefrom and mounting a rack-engaging pinion on its lower portion, a handwheel on its upper portion at a level substantially above the door track, and a chain and sprocket drive connecting the handwheel and the pinion for selectively rotating the latter to move the door between opened and closed positions. The handwheel is provided with a pivoted handle movable from a flush inoperative position to a projecting operating position.

16 Claims, 7 Drawing Figures

RAILWAY CAR DOOR MOVING MEANS

BACKGROUND OF THE INVENTION

1. Field of the Invention:

The invention relates to means for opening and closing sliding doors, particularly sliding doors of railway house cars.

2. The Prior Art:

Railway car door moving structures have frequently utilized racks mounted on the car side with manually actuating pinions journaled on the car door structure for moving the door lengthwise of the car between closed and open positions. In some instances, the rack has been mounted on the car side wall at a level substantially higher than the door track while in other instances, as exemplified by A. E. Ashleman U.S. Pat. No. 1,575,086 and two Canadian patents, George Tuman Pat. No. 159,599 and F. G. Evans Pat. No. 282,778, the racks have been mounted on the door track. In the Ashleman and Tuman patents, the rack-engaging pinions were operated directly by an operating handle affixed to the pinion shaft on the bottom of the door substantially at the center of the door, while in Evans one of the door-mounting rollers is formed with teeth on its circumference and functions as the rack-engaging pinion as well as the door supporting roller. In all of these patented structures, it would be difficult to utilize the rack and pinion operating means to open or close the door when the car was positioned beside a car floor level loading platform such as is commonly provided at freight houses and at shippers' loading docks, requiring a person operating a door with such arrangements to kneel on the platform adjacent the door and if possible extend his arm and hand into the narrow space between the platform and the car side, at the same time crawling along the platform as the door moves between closed and open positions.

SUMMARY OF THE INVENTION

The invention provides a rack and pinion mechanism for moving sliding doors, particularly those of railway house cars, between closed and open positions, in which the rack is mounted on the door mounting track substantially at the same level as the top of the track (which is advantageous in that it requires less clearance between the door and the car side than do the racks of the prior art mounted on the car side wall rearwardly of the door opening and thus permits a wider car body within maximum lateral clearance limit, and that the moving forces applied to the door are substantially in line horizontally with the door supporting rollers) while the handwheel or other manual actuating means for the pinion is positioned at a substantially higher level than the rack to facilitate operation of the pinion by an operator on a car floor level loading platform.

An object of the invention is to provide a rack and pinion mechanism for opening and closing sliding doors with the rack mounted on the door track and the manual actuating means for the pinion at a substantially higher level than the door track to facilitate operation of the mechanism when the car is adjacent close-clearance track side structures such as high level platforms.

A further object of the invention is to provide, in a rack and pinion car door moving mechanism, in which the a rack is mounted on the door track, means for operating the pinion at a level convenient to a person standing on a car floor level loading platform.

A further object of the invention is to provide, in a rack and pinion car door moving mechanism in which the rack is mounted on the door track, means for operating the pinion with substantially greater mechanical advantage than devices of the prior art.

A further object of the invention is to provide a rack and pinion mechanism for opening and closing railway car sliding side doors in which the rack is mounted on the door track but is offset longitudinally of the track completely from the door opening whereby to eliminate the likelihood of damage to the rack teeth by lift trucks and the like passing through the door, or fouling of the rack by lading such as spilled grain.

A further object of the invention is to provide a handwheel for operating the pinion equipped with a handle normally co-planar with the handwheel and readily movable to a projecting operating position substantially normal to the plane of the handwheel.

DETAILED DESCRIPTION OF THE INVENTION

Figure 1:
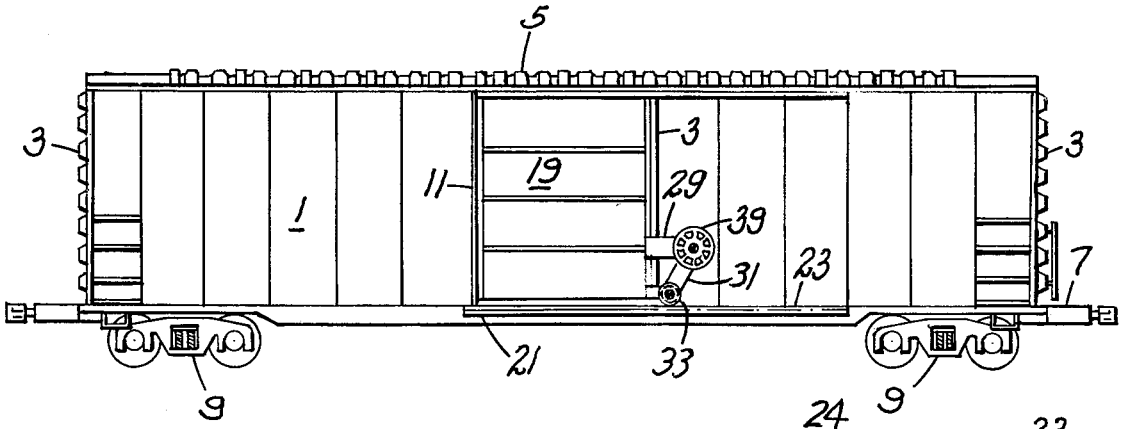
FIG. 1 is a side elevational view of a railway house car equipped with a door operating and moving device constructed in accordance with the invention.
Figure 4:
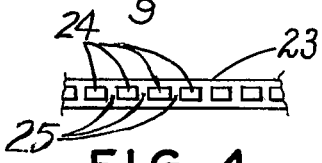
FIG. 4 is a fragmentary top view of the rack taken from lines 4—4 of FIG. 2.
Figure 2:
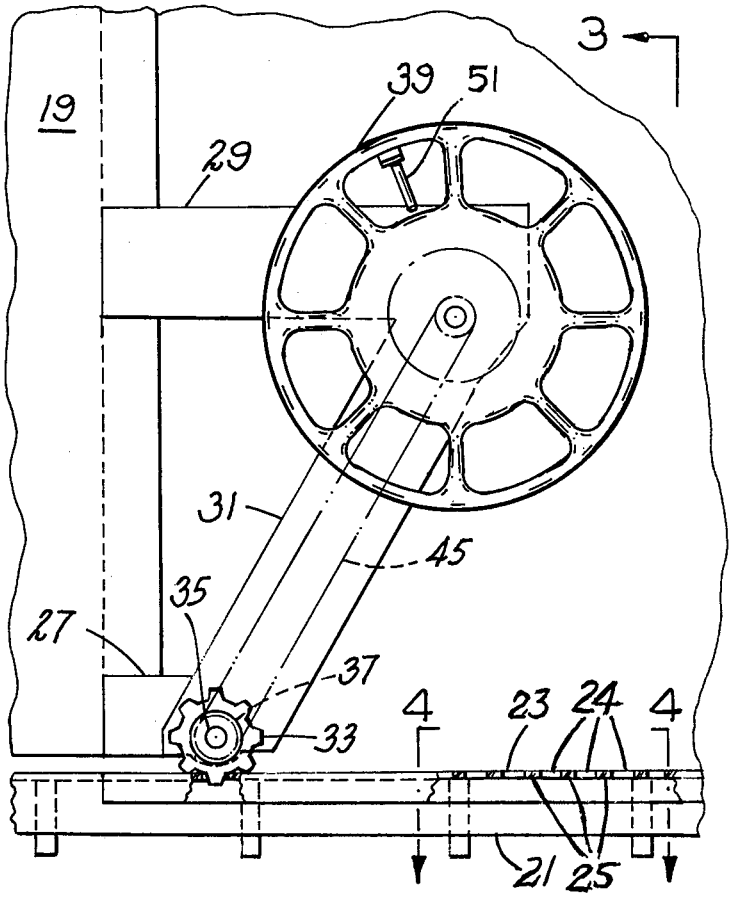
FIG. 2 is an enlarged fragmentary side elevational view of the door operating and moving device.
Figure 3:
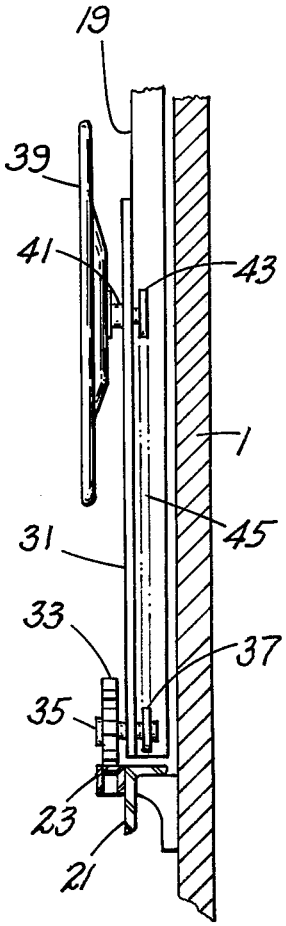
FIG. 3 is a transverse end view of the mechanism taken from and partially sectionalized along line 3—3 of FIG. 2.

The car illustrated in FIG. 1 is a standard box car comprising a body having transverse side walls 1, end walls 3, a roof 5 and an underframe having a sliding center sill 7 mounted on two four-wheel trucks 9. At its center each side wall has a rectangular door opening defined by front and rear door posts 11 and 13, side sill 15 and side plate 17 and a rectangular door 19 is slidably mounted on a door track 21 secured to side sill 15 and extending from front door post 11 to a point rearwardly of the door at least as great a distance as the width of the door.

To facilitate moving the door between closed and opened positions, a rack, consisting of a downwardly open channel with uniformly spaced openings 24 in its horizontal web, defining between them teeth 25, is secured to the outer surface of door track 21 and extends from a point immediately rearwardly of the door opening approximately to the rear end of door track 21. Bracket structure extending from the rear of the door comprises a short bottom plate 27 welded to door 19 adjacent the rear edge of the door and extending rearwardly therefrom, a somewhat longer top plate 29 spaced substantially above bottom plate 27 and similarly welded to door 19 adjacent the door rear edge, and a third diagonal plate 31 secured to bottom plate 27 and extending upwardly and rearwardly from the rear end of top plate 29 to a connection with top plate 29 near the rear end thereof. A pinion 33 meshing with the teeth 25 of rack 23 has its shaft 35 journaled in bottom plate 27 and is positioned outwardly of bottom plate 27. The inner end of pinion shaft 35, inwardly of plate 27, mounts a toothed sprocket 37. To permit manual operation of pinion 33 from a level substantially higher than the bottom of the door whereby to facilitate opening and closing of the door when the car is spotted at a high level platform, an operating handwheel 39 has its shaft 41 journaled in the bracket structure at a substantially higher level than pinion 33, preferably in the region of the intersection of the top and diagonal bracket plates, and a sprocket 43 is mounted on handwheel shaft 41 transversely inwardly of plates 29 and 31. Handwheel sprocket 43 and pinion sprocket 37 are operatively connected by a driving chain 45 such that if it is desired to open or close door 19, a worker on the loading platform may do it in a nearly erect position by manipulating handwheel 39 in the direction of the desired movement of the door. It will be noted that the downwardly open channel section rack will not be readily fouled as would a conventional upwardly toothed rack because any foreign matter deposited on the upper surface of the channel section rack would either fall through the rack-forming openings 24 in the rack or be pushed through them by the pinion teeth.

Figure 5:
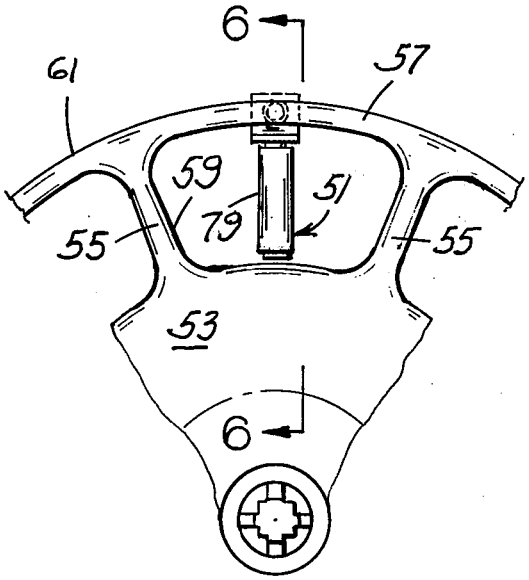
FIG. 5 is an enlarged fragmentary side elevational view of the pinion-operating handwheel showing application of a handle thereto.
Figure 6:
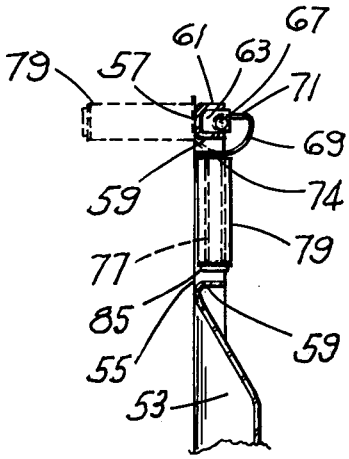
FIG. 6 is a vertical sectional view taken along line 6—6 of FIG. 4.
Figure 7:
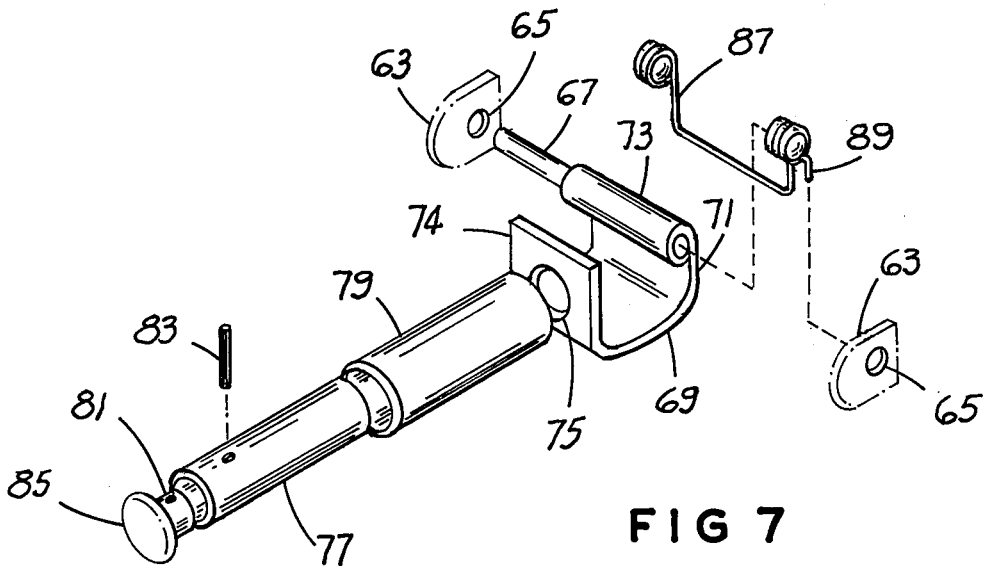
FIG. 7 is an exploded perspective view of the handle.

To facilitate manual rotation of handwheel 39, it is preferably provided with a handle assembly 51 (as best seen in FIGS. 5–7) which is movable from a non-operating position substantially co-planar with the handwheel to an operating position normal to the plane of the handwheel. Handwheel 39 is preferably formed of pressed metal with an inwardly dished central plate portion 53, a plurality of radial spokes 55 spaced apart circumferentially of the plate and a circumferential rim 57, the apertures defined by the outer edge of the central plate 53, spokes 55 and rim 57 having an inwardly directed flange 59 and the rim having an outer peripheral flange 61 such that the spokes 55 and rim 57 are of inwardly open channel cross section. Intermediate one pair of spokes 55, a pair of plate elements 63 shaped to conform to the inner surface of the channel section rim are secured in spaced apart relation within the rim channel and are centrally perforated at 65 to mount a pivot pin 67 extending substantially tangentially of the handwheel.

Handle assembly 51, as seen in FIG. 6 in inoperative position, includes a plate 69 of generally J-shape with its short leg 71 curved as at 73 to form a bearing about pivot pin 67, its curved end extending around the inner flange 59 of the rim and its long leg 74 positioned radially inwardly of the rim inner flange 59 and apertured at 75 to mount a cylindrical element 77 normal to the plane of leg 74. A rotatable sleeve 79 is carried on cylindrical element 77 and is held thereon by a plug 81 secured in the end of cylindrical element 77 by a pin 83 and formed with an enlarged head 85 engageable with the end of sleeve 79 to prevent its removal from cylindrical element 77. A torsion spring 87 mounted on pin 67 and anchored at 89 to one of the pivot pin mounting plates 63 engages the short leg 71 of the J-shape member 69 to bias the entire handle to the flush position shown in FIG. 6, wherein the handle sleeve 79 is substantially co-planar with the general plane of the spokes and rim of the handwheel. To use the handle for operating the handwheel, the operator grasps sleeve 79 and swings the handle to the broken line position of FIG. 5, wherein the long leg 74 of the handle-mounting J-shaped plate 69 abuts the web of rim 51. The handwheel may then be manually rotated with ease by means of sleeve 79.

Operation of the device is as follows: If it is desired to open the door, a worker grips handwheel 39 and commences to rotate it clockwise, i.e., from left to right in the opening direction of the door. Through handwheel sprocket 39 and drive chain 45 the rotation of the handwheel is transmitted to the pinion sprocket 37 which in turn rotates pinion 33 clockwise causing it to move rearwardly, i.e., to the right, along rack 23 and pulling door 19 in the same direction until the door is fully opened. The door is returned to closed position by a simple reversal of the opening procedure, i.e., by manually rotating handwheel 39 counterclockwise or to the left so as to cause corresponding rotation of pinion 33 and forward or leftward movement of the door toward closed position. If the car is spotted at a high level freight platform, because of the elevated position of the handwheel a worker on the platform can readily operate the handwheel and move the door without attempting to reach between the car side wall and the edge of the platform, as would be required in prior art devices in which the door-operating pinion was operated by an operating handle mounted on the pinion shaft itself. The upper location of the handwheel also permits the use of a large diameter handwheel which in turn provides substantially greater mechanical advantage in rotating the pinion than could be provided if the pinion rotation were effected by an operating handle mounted directly on the pinion shaft. As shown in the drawings, the handwheel is mounted a sufficient distance above the door track to permit operation by someone standing on a high level platform while being positioned at a sufficiently low level to be operated by someone standing at track level. If the car is used for pulverulent or granular lading, such as grain, which is discharged by opening the door, the fact that the rack is offset from the door opening will prevent the lading from fouling the toothed upper portion of the rack.

The details of the invention may be varied substantially without departing from the spirit of the invention and the exclusive use of such modifications as come within the scope of the claims is contemplated.

I claim:

1. Door moving structure for a railway house car having a side wall with a door opening, a door slidable along the wall to close and expose the door opening, an elongated track below the door for movably supporting the door between closed and open positions, a toothed rack mounted on said door track and extending longitudinally thereof, bracket structure mounted on the door adjacent the rear edge thereof and extending rearwardly therefrom with its upper portion at a level substantially higher than said door track, a pinion meshing with said rack and having its shaft journaled on the lower part of said bracket structure and a sprocket on said pinion shaft, a driving sprocket having its shaft journaled on an upper portion of said bracket structure, an endless chain operatively connecting said sprockets and a manually actuable member fixed to said driving sprocket shaft for selective manual rotation of said pinion whereby to effect opening and closing movements of said door, said driving sprocket shaft and manually actuable member thereon being positioned at a level substantially higher than said door track whereby to permit and facilitate operation of said pinion by an operator standing on a surface near the level of said door track.

2. Door moving structure according to claim 1, wherein the driving sprocket and manually actuable means is positioned a substantial distance rearwardly of the rear edge of said door.

3. Door moving structure according to claim 1, wherein said pinion and said driven sprocket are positioned closely adjacent to the rear edge of said door.

4. Door moving structure according to claim 3, wherein said rack extends from the vicinity of the rear edge of the door opening to a point rearwardly thereof a distance at least equal to the width of the door.

5. Door moving structure according to claim 3, wherein said driving sprocket and manually actuable means are positioned a substantially greater distance rearwardly of said door than said pinion and said driven sprocket and said driving chain is inclined upwardly and rearwardly from said driven sprocket to said driving sprocket.

6. Door moving structure for a railway house car having a side wall with a door opening, a door slidable along the wall to close and expose the door opening, an elongated track below the door for movably supporting the door between closed and open positions, a toothed rack mounted on said door track and extending longitudinally thereof, bracket structure mounted on the door adjacent the rear edge thereof and extending rearwardly therefrom, a pinion meshing with said rack and having its shaft journaled on the lower part of said bracket structure and a sprocket on said pinion shaft, a driving sprocket having its shaft journaled on an upper portion of said bracket structure, an endless chain operatively connecting said sprockets and a manually actuable member fixed to said driving sprocket shaft for selective manual rotation of said pinion whereby to effect opening and closing movements of said door, said pinion and said driven sprocket being positioned closely adjacent the rear edge of said door, said driving sprocket and manually actuable means being positioned a substantially greater distance rearwardly of said door than said pinion and said driven sprocket, said driving chain being inclined upwardly and rearwardly from said driven sprocket to said driving sprocket, said bracket structure comprising a short bottom horizontal member, a substantially longer horizontal top member spaced vertically from said bottom member, and an inclined member of substantially the same inclination as the driving chain and of greater width than the diameter of the sprockets, whereby to cover said driving chain and protect it from damage.

7. Door moving structure according to claim 6, wherein said manually actuable means comprises a handwheel.

8. Door moving structure according to claim 7, wherein said rack is secured to the outer surface of said door mounting track and has upwardly facing teeth, said sprockets and said chain being positioned substantially inwardly transversely of the car side with respect to said pinion, and said inclined plate member being positioned outwardly of said chain and sprockets and inwardly of said pinion and said handwheel.

9. Door moving structure according to claim 1, wherein said rack comprises a horizontal web formed with perforations uniformly spaced lengthwise and defining said teeth between them.

10. Door moving structure according to claim 9, wherein said rack includes downwardly extending longitudinal flanges on said web and forming with said web a downwardly open channel member.

11. Door moving structure according to claim 7, wherein said handwheel has a circumferential rim spaced from the center of said handwheel, a handle pivoted to said rim on an axis tangential thereto and movable from an inoperative position flush with said handwheel and extending radially inwardly from said rim to an operative position normal to the general plane of said handwheel and extending transversely outwardly therefrom.

12. Door moving structure according to claim 11, wherein said rim is of channel cross-section open inwardly toward the car side wall and said handle is pivoted to said rim inwardly of said channel, said handle having a pivot end portion extending radially from, then circumferentially of, then tangent to the pivot axis, whereby to permit said handle to be swung from the radial inoperative position to the operative position wherein said end portion inner surface engages the web of said rim, said handle having an elongated hand-engageable portion normal to the tangential portion of said pivot-forming end portion.

13. Door moving structure according to claim 12, wherein said hand-engageable portion of said handle comprises a cylindrical member and a sleeve rotatably mounted thereon.

14. Door moving structure for a railway house car having a side wall with a door opening, a door slidable along the wall to close and expose the door opening, an elongated toothed rack mounted on said car side wall and extending longitudinally thereof, structure connected to said door and positioned rearwardly thereof and rotatably mounting a pinion meshing with said rack, a handwheel rotatably mounted on said structure and drivably connected to said pinion, said handwheel having a circumferential rim spaced from the center of said handwheel, a handle pivoted to said rim on an axis tangential thereto and movable from an inoperative position substantially flush with said handwheel and extending radially inwardly from said rim to an operative position normal to the general plane of said handwheel and extending transversely outwardly therefrom, said rim being of channel cross section open inwardly toward the car side wall and said handle being pivoted to said rim inwardly of said channel, said handle having a pivot end portion extending radially from, then circumferentially of, then tangent to the pivot axis, whereby to permit said handle to be swung from the radial inoperative position to the operative position, wherein said end portion inner surface engages the web of said rim, said handle having an elongated hand-engageable portion normal to the tangential portion of said pivot-forming end portion.

15. Door moving structure according to claim 14, wherein said hand-engageable portion of said handle comprises a cylindrical member and a sleeve rotatably mounted thereon.

16. The combination with a handwheel having a circumferential rim, of a handle pivoted to said rim on an axis tangential thereto and movable from an inoperative position in the general plane of said handwheel, wherein it extends radially inwardly from said rim, to an operative position normal to the general plane of said handwheel, said handwheel rim being of channel cross-section and said handle being pivoted to said rim within the interior of the rim, said handle having a pivot end portion extending radially from, then circumferentially of, then tangent to, the pivot axis, whereby to permit said handle to be swung from the radial inoperative position to the operative position, wherein said end portion inner surface engages the web of said rim, said handle having an elongated hand-engaging portion normal to the tangential portion of said pivot-forming end portion.

* * * * *